United States Patent [19]

Oyague et al.

[11] 4,288,076

[45] Sep. 8, 1981

[54] FOLDABLE GAMEBOARD AND DISC PLAYING PIECE APPARATUS

[76] Inventors: Ralph Oyague, c/o George Spector, 3615 Woolworth Bldg., 233 Broadway; George Spector, 3615 Woolworth Bldg., 233 Broadway, both of New York, N.Y. 10007

[21] Appl. No.: 3,639

[22] Filed: Jan. 15, 1979

[51] Int. Cl.[3] ..... A63F 3/00

[52] U.S. Cl. ..... 273/126 R; 273/128 R; 273/129 S

[58] Field of Search ..... 273/126 R, 128 R, 119 R, 273/119 A, 119 B, 121 R, 121 A, 121 D, 129 S; 124/16, 83

[56] References Cited

U.S. PATENT DOCUMENTS

| | | | |
|---|---|---|---|
| 373,136 | 11/1887 | Freeman | 273/119 R |
| 826,339 | 7/1906 | Lang | 273/119 R |
| 951,805 | 3/1910 | Eldridge | 273/126 |
| 1,454,982 | 5/1923 | Pye | 273/119 R |
| 2,814,285 | 11/1957 | Yamauchi | 124/49 |
| 2,841,398 | 7/1958 | Conner | 124/50 |
| 3,008,718 | 11/1961 | Berliner | 273/126 R |
| 3,997,163 | 12/1976 | Cooper | 273/119 A |

FOREIGN PATENT DOCUMENTS

| | | | |
|---|---|---|---|
| 476811 | 9/1949 | Canada | 273/126 R |

*Primary Examiner*—Richard C. Pinkham
*Assistant Examiner*—T. Brown

[57] ABSTRACT

A game device that includes a foldable, large gameboard with playing spaces marked out thereupon, a set of various different colored playing pieces for movement on the gameboard, and several shooters for propelling the playing pieces toward the gameboard spaces.

3 Claims, 6 Drawing Figures

FOLDABLE GAMEBOARD AND DISC PLAYING PIECE APPARATUS

This invention relates generally to competitive games played upon gameboards.

A principal object of the present invention is to provide a novel game in which playing pieces are propelled by a weapon-like shooter for movement upon a relatively very large gameboard.

Another object is to provide a SKELL-ZY game that will appeal to both children and adults.

Figure 1:
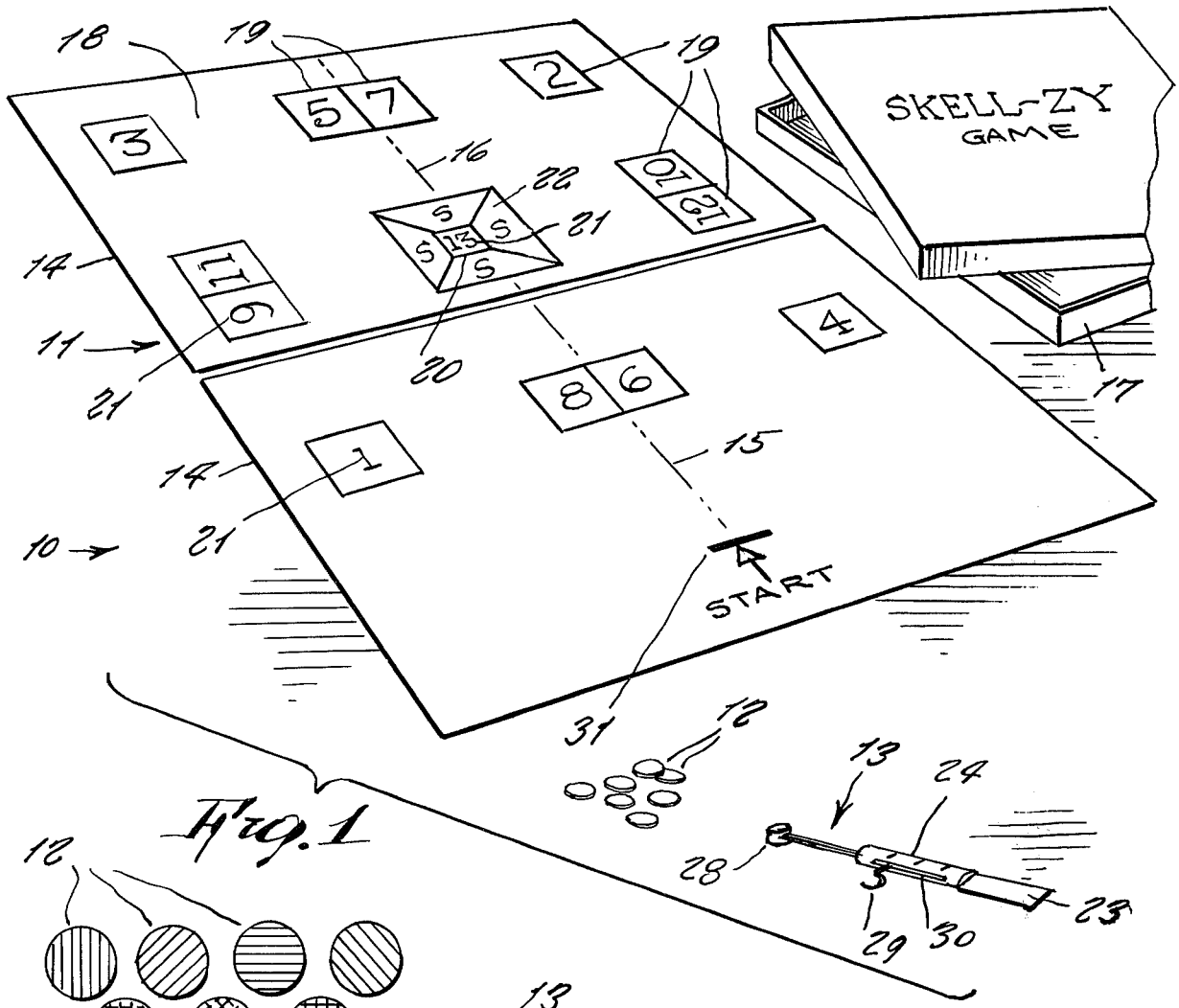
FIG. 1 is a perspective view of the invention.

Referring now to the drawing in greater detail, and more particularly to FIGS. 1 through 4 thereof, the reference numeral 10 represents a Skell-Zy game according to the present invention, wherein there is a gameboard 11 upon which playing pieces 12 are moved by means of a hand held shooter 13.

The gameboard is comprised of panels 14 and measures 6 by 8 foot when opened. It can be folded up on transverse fold lines 15 and 16 so to fit into a conveniently carried box 17. A playing field 18 on one side of the gameboard includes spaces 19 arranged around a central space 20. Each space is designated with a numeral as shown at 21, the numeral running from "1" to "13". The central spaces having numeral "13" is framed by four spaces 22 each of which has a symbol "S".

Figure 2:
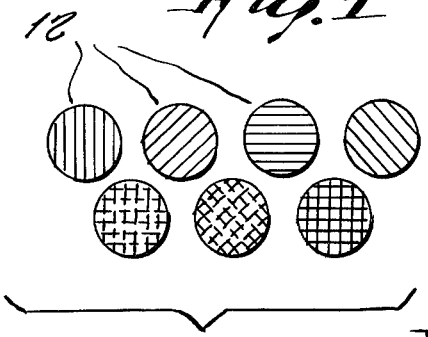
FIG. 2 is an enlarged top view of the discs showing each of a different color.
Figure 3:
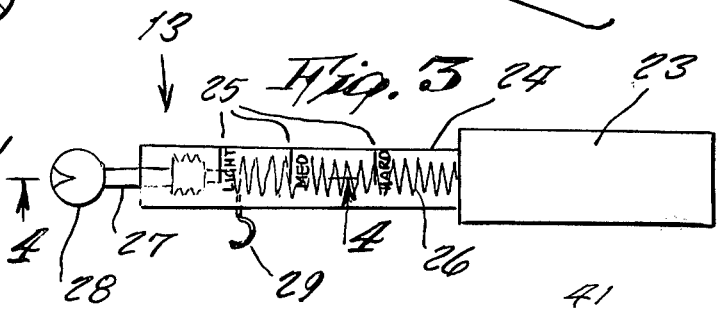
FIG. 3 is a side view of one of the spring action shooters.
Figure 4:
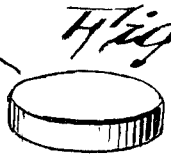
FIG. 4 is a perspective view of one of the playing pieces, shown enlarged.

There are seven playing pieces 12, each of which is a flat circular disc painted or made in an individually different color, as indicated by symbols in FIG. 2. They may be made of marble for easy sliding capability upon the gameboard, if so wished.

The game includes seven of the shooters 13, so that up to seven players can each have their own shooter as well as playing piece.

Each shooter is comprised of a hand grip 23 secured to one end of a transparent, plastic, tubular barrel 24 having calibrations "light", "medium" and "hard" imprinted thereupon as shown at 25. A compression coil spring 26 inside the barrel, rests at one end against the grip, and an opposite end thereof is secured to a stem 27 extending outwardly of an end opening in the barrel, the outward end of the stem having a circular hitting plate 28 formed on its end. A reversible thumb puller 29 secured to the spring extends outwardly of the barrel through a longitudinal slot 30 along the barrel.

In playing the game, each player initially shoots his playing piece from a start line 31 printed at one end of the playing field. By pulling the puller 29 he contracts the spring, so that when released, with the hitter plate abutted against the playing piece, the piece is pushed across the playing field, aimed at a space.

Figure 5:
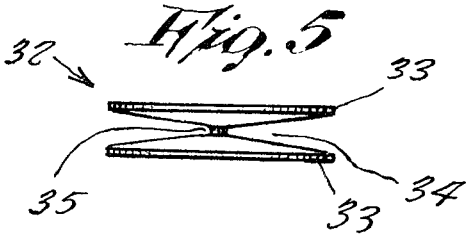
FIG. 5 is a side view of another design of playing piece.

In FIG. 5, a modified design of playing piece 32 is diabolo-shaped by being comprised of two conical members 33 on opposite sides of an annular groove 34 formed therebetween, the two members being joined by a short central stem 35 therebetween. If the stem is made of a resilient rubber, and if the shooter strikes only a rim of a lower member resting on the gameboard, then the striking impact will tilt the upper member, inclining it rearwardly downward as the playing piece is propelled in forward travel, so that the upper member serves as an airfoil that gently lifts the piece off the gameboard surface during travel.

Figure 6:
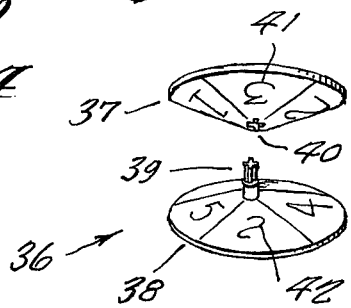
FIG. 6 is a perspective view of still another design of playing piece similar to FIG. 5, but which is made of two interfitting parts so to selectively align scoring numbers on each.

In a further modified design shown in FIG. 6, a playing piece 36, similar in appearance to piece 32 is made with separatable cone shaped members 37 and 38 that snap fit together by a splined, resilient stem 39 on one snap fitting in a splined hole 40 of the other, so to selectively align numerals 41 on one cone with numerals 42 of the other so to compose different scoring numbers which may be used in some forms of playing the game. The numbers on members 37 and 38 may be aligned to indicate various possible scoring arrangements a total of points by summing the upper and lower aligned number in accordance with the numbered playing spare that the piece has come to rest, thus creating a variable interesting scoring system.

What is claimed:

1. A game, comprising in combination, gameboard, a set of playing pieces for movement upon said gameboard, and a plurality of shooters for hitting said playing pieces to propel them over the gameboard said gameboard comprising a pair of foldable panels which together upon one side thereof include a printed playing field of numbered playing spaces around a central playing space, and a starting line at one end of said playing field, said playing pieces each being individually differently colored and including air lift means for causing each piece to lift upon being propelled by said shooter, each said shooter comprising a calibrated, transparent barrel having a hand grip attached to one end thereof, a compression coil spring inside said barrel and having one of its ends attached to one end of a stem, said stem projecting from the opposite end of said barrel, and a hitting plate attached to the other end of said stem for contacting said playing pieces, and a puller attached to said spring for retracting the same into operative position.

2. The combination as set forth in claim 1, wherein each said playing piece includes an upper conical member, axially aligned with a lower conical member having conical sides facing each other and a resilient central stem spacedly connecting said members along the axis of rotation of said members.

3. The combination as set forth in claim 2, wherein said stem affixed to one said member, is splined and snap fits in a splined hole of the other member, and a circular row of numerals printed on a conical surface of each said member, for selective alignment to provide means for indicating a score.

* * * * *